US008723773B2

(12) United States Patent
Tajiri

(10) Patent No.: US 8,723,773 B2
(45) Date of Patent: May 13, 2014

(54) ELECTRO-OPTICAL DEVICE AND ELECTRONIC APPARATUS

(75) Inventor: Kenichi Tajiri, Nagano (JP)

(73) Assignee: Japan Display West Inc., Aichi-Ken (JP)

( * ) Notice: Subject to any disclaimer, the term of this patent is extended or adjusted under 35 U.S.C. 154(b) by 1598 days.

(21) Appl. No.: 11/854,487

(22) Filed: Sep. 12, 2007

(65) Prior Publication Data

US 2008/0074371 A1 Mar. 27, 2008

(30) Foreign Application Priority Data

Sep. 25, 2006 (JP) ..... 2006-258774

(51) Int. Cl.
*G09G 3/36* (2006.01)

(52) U.S. Cl.
USPC ..... 345/89

(58) Field of Classification Search
USPC ..... 345/87–94
See application file for complete search history.

(56) References Cited

U.S. PATENT DOCUMENTS

| | | | | |
|---|---|---|---|---|
| 6,396,554 | B1 * | 5/2002 | Matsuda | 349/139 |
| 6,493,112 | B1 * | 12/2002 | Arce et al. | 358/3.19 |
| 2003/0052852 | A1 * | 3/2003 | Oohira | 345/89 |
| 2006/0103800 | A1 * | 5/2006 | Li et al. | 349/129 |

FOREIGN PATENT DOCUMENTS

| | | |
|---|---|---|
| JP | 05-341734 | 12/1993 |
| JP | 06-214214 | 8/1994 |
| JP | 06-301010 | 10/1994 |
| JP | 07-261155 | 10/1995 |
| JP | 09-127530 | 5/1997 |
| JP | 10-068931 | 3/1998 |
| JP | 11-501413 | 2/1999 |
| JP | 11-142881 | 5/1999 |
| JP | 2001343941 | 12/2001 |
| JP | 2002040994 | 2/2002 |
| JP | 2002333870 | 11/2002 |
| JP | 2003-143556 | 5/2003 |
| JP | 2004062146 | 2/2004 |
| JP | 2005010579 | 1/2005 |
| JP | 2006078789 | 3/2006 |

* cited by examiner

*Primary Examiner* — Dennis Joseph

(74) *Attorney, Agent, or Firm* — K&L Gates LLP

(57) ABSTRACT

In accordance with an embodiment of the invention, a control unit of the electro-optical device performs black data insertion processing for all the pixels in a vertical retrace period and each of the pixels includes a first subpixel and at least one second subpixel. Accordingly, blur of a motion picture is suppressed (a motion picture is improved in visual quality) by the black data insertion processing while using the minimum number of switching devices in the pixel unit.

7 Claims, 6 Drawing Sheets

FIG. 1

UNIT: msec

| | GRAY SCALE | DATA AFTER GRAY-SCALE LEVEL IS CHANGED | | | | |
|---|---|---|---|---|---|---|
| | | 0 | 64 | 128 | 192 | 255 |
| DATA BEFORE GRAY-SCALE LEVEL IS CHANGED | 0 | | | | | |
| | 46 | 9 | 81 | 59 | 44 | 24 |
| | 128 | 9 | 31 | 27 | 24 | 14 |
| | 192 | 10 | 28 | 26 | 22 | 13 |
| | 255 | 12 | 29 | 26 | 23 | 11 |

ELECTRO-OPTICAL DEVICE AND ELECTRONIC APPARATUS

RELATED APPLICATIONS

The present application is based on, and claims priority from, Japan Application Number 2006-258774, filed Sep. 25, 2006, the disclosure of which is hereby incorporated by reference herein in its entirety.

BACKGROUND

1. Technical Field

The present invention relates to electro-optical devices, such as liquid crystal display devices, and electronic apparatuses.

2. Related Art

In general, an active matrix liquid crystal display device is well known as an example of an electro-optical device. The active matrix liquid crystal display device includes a plurality of scanning lines, a plurality of data lines, a plurality of pixels arranged so as to correspond to intersections of the plurality of scanning lines and the plurality of data lines, a scanning line driving circuit that drives the plurality of scanning lines, a data line driving circuit that drives the plurality of data lines, and a layer of liquid crystal which is an electro-optical material.

Examples of methods of driving liquid crystal include a TN (twisted nematic) method, a VA (vertical alignment) method, and an IPS (in-plane-switching) method.

Here, the VA method will be described with reference to FIGS. 7A to 7C. In the VA method, when a voltage is not applied, liquid crystal molecules are aligned substantially upright with respect to electrodes which sandwich the liquid crystal molecules in pairs whereby light emitted from a backlight arranged on a back side is blocked and black display is attained (FIG. 7A). When a voltage having a predetermined value (an intermediate value) is applied, the liquid crystal molecules are aligned so as to be at a predetermined angle with respect to the electrodes which sandwich the liquid crystal molecules in pairs whereby part of the light emitted from the backlight arranged on the back side is transmitted (FIG. 7B). When a maximum voltage is applied, the liquid crystal molecules are flatly aligned with respect to the electrodes which sandwich the liquid crystal molecules in pairs whereby the light emitted from the backlight arranged on the back side is entirely transmitted and white display is attained (FIG. 7C).

Furthermore, in the VA method, when a voltage is not applied, since the light emitted from the backlight is not influenced from the liquid crystal molecules and is substantially blocked by a polarizing plate, pure black display is attained when compared with the TN method, and furthermore, a high contrast ratio is attained.

Furthermore, in the VA method, when compared with a response speed in a rise time (a change from black display to white display) and a response speed in a fall time (a change from white display to black display), a response speed when a halftone is displayed is intend to be low. To improve the response speed when a halftone is displayed, in general, overdrive processing is performed (for example, refer to JP-A-2003-143556).

Here, the overdrive processing will be described. The liquid crystal display device detects gray-scale data from an input image signal and supplies the detected gray-scale data to a correction circuit and a memory. The memory stores the gray-scale data for a period of one frame and outputs the gray-scale data to the correction circuit.

The correction circuit compares gray-scale data in a preceding frame with gray-scale data in a succeeding frame, corrects the gray-scale data in the succeeding frame in accordance with a result of the comparison, and applies a voltage to the liquid crystal in accordance with the correction. Accordingly, the response speed when halftone is displayed is improved by applying a large voltage to the liquid crystal.

However, for such overdrive processing, a memory is required for temporarily storing the gray-scale data in the preceding frame. Therefore, when a liquid crystal display device including a driving processing unit which is not provided with a memory such as a RAM (random access memory) is used, a memory dedicated to the overdrive processing is required to be provided. Accordingly, an area of a substrate for implementing the memory becomes large resulting in increased cost.

Furthermore, in the overdrive processing, an electric power is required for comparison and calculation of the gray-scale data in the preceding frame and the gray-scale data in the succeeding frame.

SUMMARY

An advantage of some aspects of the invention is to provide an electro-optical device capable of improving a response speed of an electro-optical material without performing overdrive processing and an electronic apparatus.

In accordance with an embodiment of the invention, there is provided an electro-optical device including: a plurality of scanning lines and a plurality of data lines; a plurality of pixels arranged so as to correspond to intersections of the plurality of scanning lines and the plurality of data lines; a scanning line driving circuit that generates selection signals used to select the plurality of scanning lines in a predetermined order, and supplies the selection signals to the plurality of scanning lines; a data line driving circuit that generates certain signals from input image data and supplies the certain signals to the plurality of data lines, each of the pixels being constituted by a first subpixel and at least one second subpixel, the first subpixel including a first pixel electrode, a common electrode which faces the first pixel electrode, and a first switching device which is turned on when a corresponding one of the selection signals is supplied through a corresponding one of the scanning lines and which electrically connects a corresponding one of the data lines to the first pixel electrode, the second subpixel including a second pixel electrode, a common electrode which faces the second pixel electrode, and a second switching device which electrically connects the corresponding one of the data lines to the second pixel electrode through the first switching device; and a signal supplying unit that supplies signals to control lines so that, for each of the pixels, the second switching device which is connected to a corresponding one of the control lines is turned on or off. In a vertical retrace period, the scanning line driving circuit supplies the selection signals to the scanning lines, the signal supplying unit supplies signals to the control lines so that, for each of the pixels, the second switching device is turned on, and the data line driving circuit supplies signals to the data lines so that, for each of the pixels, potentials of the first pixel electrode and the second pixel electrode represent a maximum gray-scale level or a minimum gray-scale level.

Accordingly, a control unit of the electro-optical device performs black data insertion processing for all the pixels in a vertical retrace period and each of the pixels includes a first subpixel and at least one second subpixel. Accordingly, blur of a motion picture is suppressed (a motion picture is improved in visual quality) by the black data insertion processing while using the minimum number of switching devices in the pixel unit.

Preferably, the electro optical device further includes: a gray-scale-level detection unit that detects a gray-scale level of the image data; and a determination unit that determines whether the gray-scale level detected using the gray-scale-level detection unit is within a range considered to be a halftone. In a case where the determination unit determines that the gray-scale level detected using the gray-scale-level detection unit is within a range considered to be a halftone, for each of the pixels, when the first switching device is turned on, the signal supplying unit may supply one of the certain signals to a corresponding one of the control lines and may turn off the second switching device.

Accordingly, in a case where the determination unit determines that the gray-scale level of the image data is within a range considered to be a halftone, since halftone display is performs in each of the pixels utilizing the first subpixel and the second subpixel, overdrive processing may be omitted.

Accordingly, since a memory necessary for the overdrive processing can be eliminated, a size of the entire device and production cost thereof can be reduced, and a response speed of the liquid crystal can be improved. Furthermore, the amount of electric power required for the overdrive processing can be reduced.

Preferably, in each of the pixels, the first subpixel and the second subpixel are arranged so as to be adjacent to each other in a direction in which the scanning lines extend, and the pixels are arranged such that, for two vertically adjacent pixels, a first subpixel and a second subpixel which are included in different pixels and therefore which are separated by a boundary between the different pixels are arranged so as to be adjacent to each other.

Accordingly, since a plurality of subpixels having different gray-scale levels are arranged so as to be adjacent to each other in the direction in which the scanning lines extend (in the horizontal direction), as with use of a dot inversion driving method, generation of flicker can be prevented.

Furthermore, preferably, in each of the pixels, the first subpixel and the second subpixel are arranged so as to be adjacent to each other in a direction in which the data lines extend, and the pixels are arranged such that, for two horizontally adjacent pixels, a first subpixel 20 and a second subpixel 30 which are included in different pixels and therefore which are separated by a boundary between the different pixels are arranged so as to be adjacent to each other.

Accordingly, since a plurality of subpixels having different gray-scale levels are arranged so as to be adjacent to each other in the direction in which the data lines extend (in the vertical direction), as with use of a dot inversion driving method, generation of flicker can be prevented. Furthermore, since a space necessary for arranging switching devices can be easily provided, a decrease in an aperture ratio which occurs due to an increase in the number of switching devices can be prevented.

Preferably, liquid crystal having negative anisotropy of dielectric constant is arranged between the first pixel electrode and the second pixel electrode on one hand and the common electrode on the other.

Accordingly, even when VA liquid crystal in which a response speed at a time of a change from low-gray-scale-level display to high-gray-scale-level display is low, for example, is employed, in a case where the determination unit determines that the gray-scale level is within a range considered to be a halftone, since halftone display is performs, in each of the pixels, utilizing the first subpixel and the second subpixel, overdrive processing may be omitted.

According to another embodiment of the invention, the electronic apparatus includes the electro-optical device described above.

Accordingly, advantages similar to those described hereinabove may be attained.

BRIEF DESCRIPTION OF THE DRAWINGS

The invention will be described with reference to the accompanying drawings, wherein like numbers reference like elements.

FIG. 1 shows a table illustrating the relationship between a gray-scale level and a response time of liquid crystal.

DESCRIPTION OF EXEMPLARY EMBODIMENTS

Figure 2:
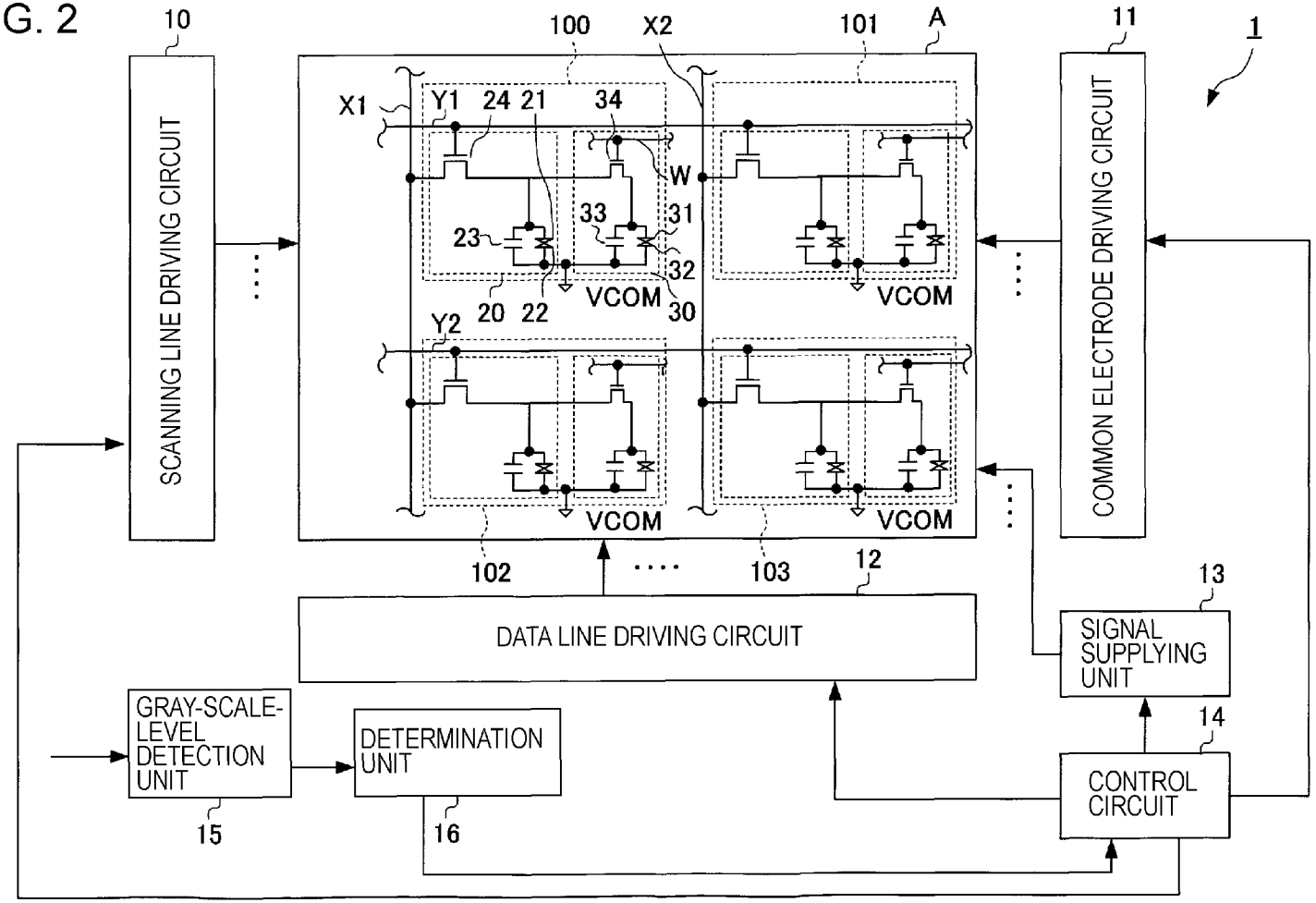
FIG. 2 shows a block diagram illustrating an example of a configuration of an electro-optical device according to an embodiment of the invention.

Embodiments of the present invention will be described hereinafter with reference to accompanying drawings. Note that in descriptions of the embodiments and modifications described hereinafter, the same reference numerals are used for the same components and descriptions thereof are omitted or simplified.

FIG. 1 shows a table illustrating the relationship between a gray-scale level and a response time of liquid crystal.

In a case where a gray-scale level of an image signal in a preceding frame is "0" and a gray-scale level of an image signal in a succeeding frame is "64", a response time of liquid crystal is 81 msec. Similarly, in a case where the gray-scale level of the image signal in the preceding frame is "0" and the gray-scale level of the image signal in the succeeding frame is "128", "192", or "255", the response time of liquid crystal is 59 msec, 44 msec, or 24 msec, respectively. Similarly, as shown in FIG. 1, in a case where the gray-scale level of the image signal in the preceding frame is "64", "128", "192", or "255", a response time is determined in accordance with the gray-scale level in the succeeding frame.

As is apparent from FIG. 1, when compared with a response speed in a case where a gray-scale level is changed from a low level to a high level and a response speed in a case where a gray-scale level is changed from a high level to a low level, a response speed in a case where a gray-scale level is changed from a low level to a halftone and a response speed in a case where a gray-scale level is changed from a high level to a halftone take more time.

According to the embodiments of the invention, in a case where a gray-scale level is changed to a halftone, a response speed of liquid crystal is improved by performing pulse-surface-area modulation using divided pixels without performing overdrive processing. Furthermore, according to the embodiments of the invention, a motion picture is improved in visual quality without a decrease in an aperture ratio by performing pulse-surface-area modulation so that the response speed of the liquid crystal is improved and by performing black data insertion processing.

Embodiment of the invention will now be described.

The electro-optical device 1 employs an MVA (multi domain vertical alignment) method and utilizes liquid crystal having negative anisotropy of dielectric constant ($\Delta\in<0$).

Figure 3:
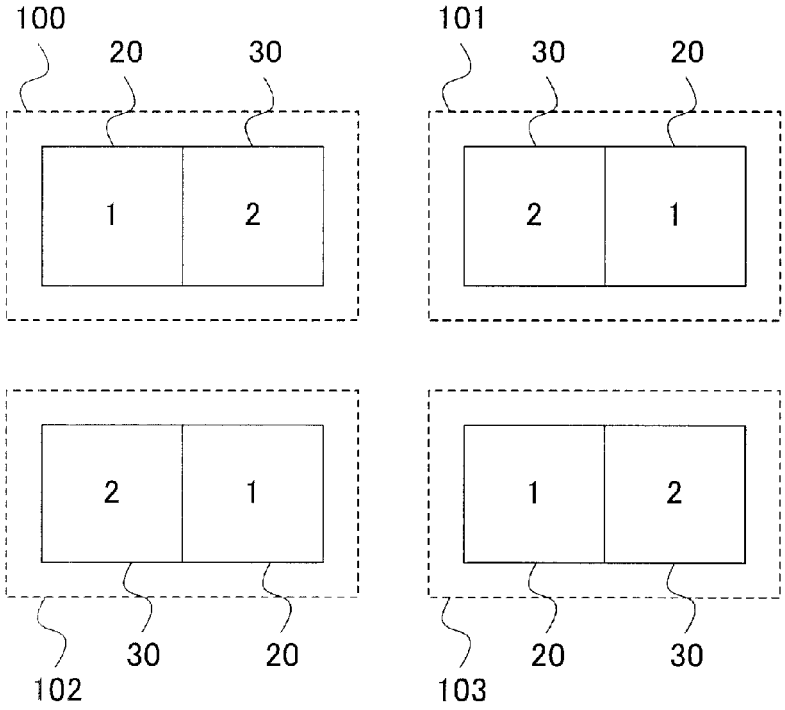
FIG. 3 shows first arrangement of pixel units of the electro-optical device according to the embodiment of the invention.

As shown in FIG. 2, the electro-optical device 1 includes a pixel unit A, a scanning line driving circuit 10, common electrodes 22 and 32, a common electrode driving circuit 11, a data line driving circuit 12, a signal supplying unit 13, a control circuit 14, a gray-scale-level detection unit 15, and a determination unit 16. The pixel unit A is a display area including a plurality of pixels. The scanning line driving circuit 10 selectively drives the plurality of scanning lines Y in a predetermined order. The common electrode driving circuit 11 supplies voltages to be applied to the common electrodes 22 and 32. The data line driving circuit 12 supplies image signals generated on the basis of image data to the data lines X when one of the scanning lines Y is selected. The signal supplying unit 13 supplies certain signals to control lines W. The control circuit 14 controls the scanning line driving circuit 10, the common electrode driving circuit 11, the data line driving circuit 12, and the signal supplying unit 13. The gray-scale-level detection unit 15 detects a gray-scale level of the image data. The determination unit 16 determines whether the gray-scale level detected using the gray-scale-level detection unit 15 is within a range considered to be a halftone. The electro-optical device 1 further includes a backlight unit, not shown, which illuminates the pixel unit A from the back side thereof. Note that only a portion (four pixels, that is, a first pixel 100, a second pixel 101, a third pixel 102, and a fourth pixel 103) of the pixel unit A is shown in FIG. 3.

Here, a configuration of the pixel unit A will be described in detail. Note that each of the pixels according to the embodiment of the invention includes at least two adjacent subpixels as a group. Description will be made hereinafter for each of the pixels including two subpixels, that is, a first subpixel 20 and a second subpixel 30.

The first subpixel 20 includes, as shown in FIG. 2, a pixel electrode 21, a counter electrode 22 arranged so as to face the pixel electrode 21, a storage capacitor 23 which stores charge, and a first switching device 24 (for example, a TFT (thin-film transistor)) used for electrically connecting the pixel electrode 21 to a corresponding one of the data lines X in accordance with one of the selection voltages supplied from a corresponding one of the scanning lines Y.

The first switching device 24 is connected to the pixel electrode 21 through a first terminal (a source terminal or a drain terminal), is connected to one of the scanning lines Y through a second terminal (a gate terminal), and is connected to one of the data lines X through a third terminal (a drain terminal or a source terminal).

The second subpixel 30 includes, as shown in FIG. 2, a pixel electrode 31, a common electrode 32 arranged so as to face the pixel electrode 31, a storage capacitor 33 which stores charge, and a second switching device 34 used for electrically connecting the pixel electrode 31 to the first switching device 24 in accordance with one of switching signals supplied from corresponding one of the control lines W. Note that the counter electrode 22 and the common electrode 32 are integrally configured and are integrally called a common electrode 40.

The second switching device 34 is connected to the pixel electrode 31 through a first terminal (a source terminal or a drain terminal), is connected to one of the control lines W through a second terminal (a gate terminal), and is connected to the first terminal of the first switching device 24 through a third terminal (a drain terminal or a source terminal) similarly to the third terminal of the first switching device 24.

Arrangement of the subpixels in each of the pixels in the pixel unit A will now be described.

Pixel Unit A: First Arrangement

As shown in FIG. 3, in each of the pixels, the first subpixel 20 and the second subpixel 30 are arranged so as to be adjacent to each other in a direction the scanning lines Y extend (in the horizontal direction). Furthermore, the pixels are arranged such that, for two vertically adjacent pixels, a first subpixel 20 and a second subpixel 30 which are included in different pixels and therefore which are separated by a boundary between the different pixels are arranged so as to be adjacent to each other.

According to the arrangement of the pixels, since, in each of the pixels, the first subpixel 20 and the second subpixel 30 are connected to each other in the horizontal direction, generation of flicker can be prevented.

Pixel Unit A: Second Arrangement

Figure 4:
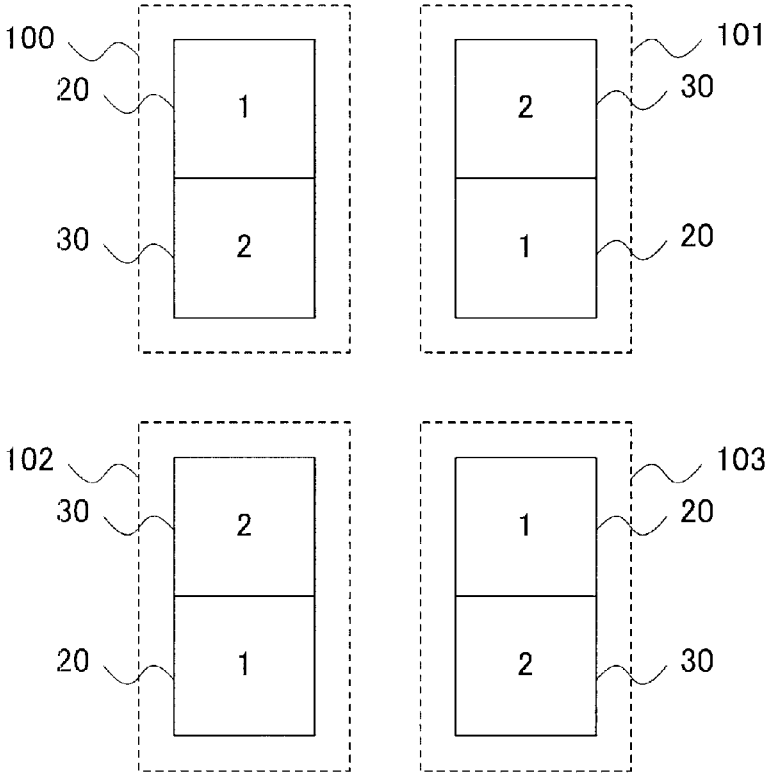
FIG. 4 shows second arrangement of pixel units of the electro-optical device according to the embodiment of the invention.

As shown in FIG. 4, in each of the pixels, the first subpixel 20 and the second subpixel 30 are arranged so as to be adjacent to each other in a direction the data lines X extend (in the vertical direction). Furthermore, the pixels are arranged such that, for two horizontally adjacent pixels, a first subpixel 20 and a second subpixel 30 which are included in different pixels and therefore which are separated by a boundary between the different pixels are arranged so as to be adjacent to each other.

According to the arrangement of the pixels, since, for each of the pixels, the first subpixel 20 and the second subpixel 30 are connected to each other in the vertical direction, generation of flicker can be prevented. Furthermore, since a space necessary for arranging switching devices can be easily provided, a decrease in an aperture ratio which occurs due to an increase in the number of switching devices can be prevented.

The scanning line driving circuit 10 sequentially supplies selection signals to the scanning lines Y so that, in each of the pixels, the first switching device 24 is brought into a conduction state.

The common electrode driving circuit 11 supplies a first voltage and a second voltage having a potential higher than the first voltage to the common electrode 40 alternately every one horizontal scanning period. Furthermore, the common electrode driving circuit 11 inverts a voltage (Vcom) to be applied to the common electrode 40 every one horizontal scanning period. Accordingly, the liquid crystal is driven by an alternating current, and as a result, deterioration thereof can be prevented.

The data line driving circuit 12 supplies pieces of image data to the data lines X and writes, for each of the pixels, an image voltage generated in accordance with one of the pieces of image data to the pixel electrode 21 through the first switching device 24 which is in an on-state. Furthermore, the data line driving circuit 12 writes an image voltage generated in accordance with one of the pieces of image data to the pixel electrode 31 when the second switching device 34 is in an on-state.

Here, the data line driving circuit 12 performs positive-polarity writing in which pieces of image data which have potentials higher than that of the common electrode 40 are supplied to the data lines X and image voltages generated on the basis of the image signals having the positive polarities are written to the pixel electrodes 21 and 31, and performs negative-polarity writing in which pieces of image data which have potentials lower than that of the common electrode 40 are supplied to the data lines X and image voltages generated on the basis of the image signals having the negative polarities are written to the pixel electrodes 21 and 31. The positive-polarity writing and the negative-polarity writing are alternately performed every horizontal scanning line.

The signal supplying unit 13 supplies a certain signal to each of the control lines W connected to the corresponding second switching device 34 so that the second switching device 34 is turned on or off.

The control circuit 14 performs processing of insertion of a black screen, that is, black data insertion processing for all the pixels in a vertical retrace period so that blur of a motion picture is prevented. Note that the control circuit 14 functions as a timing controller, and generates predetermined timing signals and supplies the timing signals to the scanning line driving circuit 10, the common electrode driving circuit 11, and the data line driving circuit 12.

Here, the necessity of the black data insertion processing will be described. In a liquid crystal display device, an image displayed in a frame is retained by the time immediately before the frame is changed to the next frame. This is called a hold type display method. Therefore, from the nature of the human eyes, a residual image is generated when a motion picture is displayed resulting in an unclear displayed image (hereinafter referred to as blur of a motion picture). Note that, in a CRT (cathode ray tube) and a PDP (plasma display panel), since an impulse type display method in which an image is displayed using a light pulse is employed, such blur of a motion picture is not generated.

To reduce such blur of a motion picture, the control circuit 14 inserts a black screen every one frame in a vertical retrace period.

Figure 5:
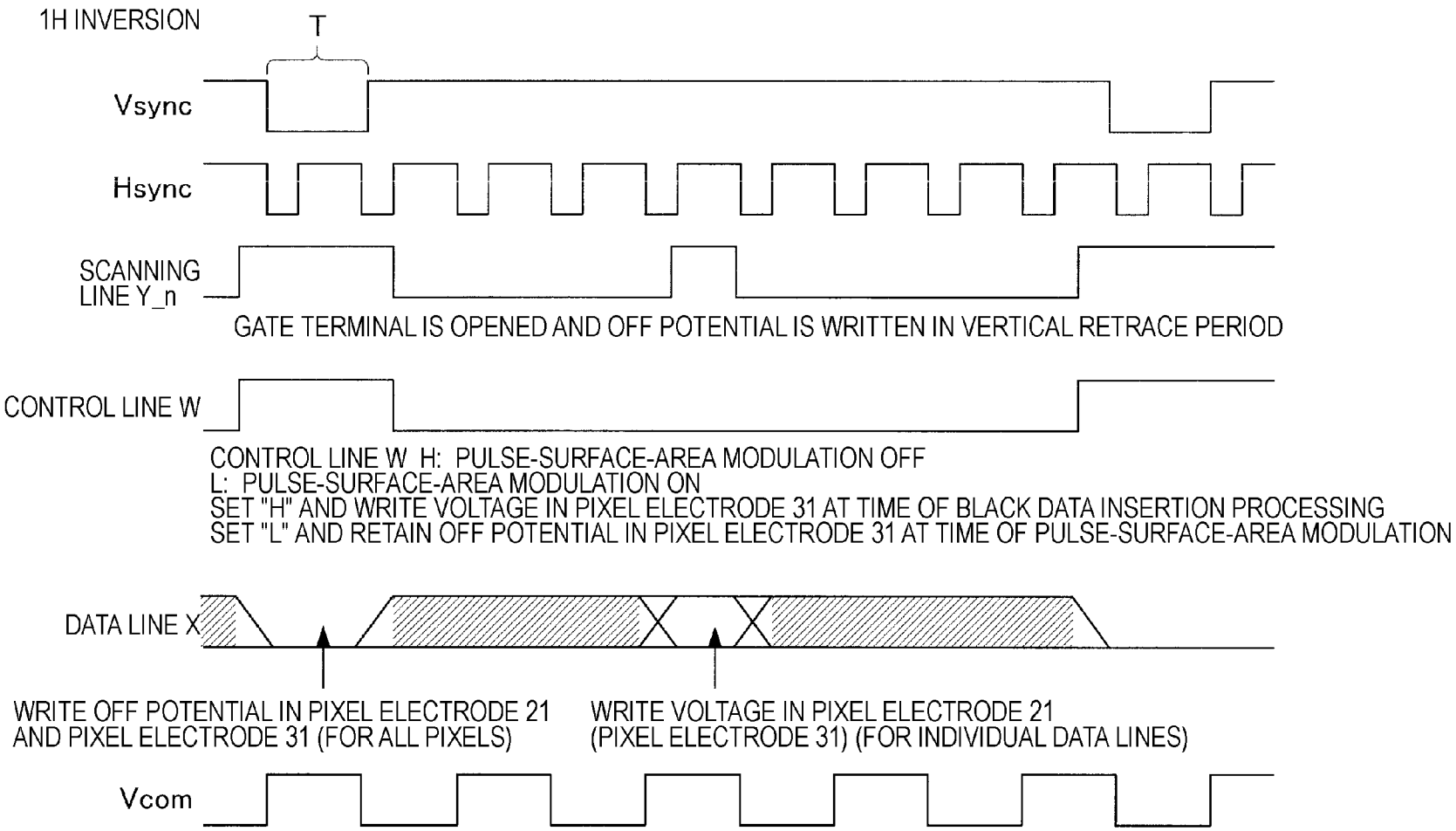
FIG. 5 shows a waveform chart illustrating a timing of supplying one of selection signals to a corresponding one of a plurality of scanning lines, a timing of supplying one of certain voltages to a corresponding one of a plurality of control lines, and a timing of supplying one of certain voltages to a corresponding one of a plurality of data lines.

Specifically, as shown in FIG. 5, in a vertical retrace period T, the control circuit 14 controls the scanning line driving circuit 10 to supply selection signals to the scanning lines Y, controls the signal supplying unit 13 to supply certain signals to the control lines W, and controls the data line driving circuit 12 to supply signals to the data lines X so that potentials of the pixel electrode 21 and the pixel electrode 31 represent a maximum gray-scale level or a minimum gray-scale level. Note that in a case where a so-called normally-black mode is employed as a display method, the control circuit 14 controls the data line driving circuit 12 to supply certain signals to the data lines X so that the pixel electrode 21 and the pixel electrode 31 have potentials the same as that of the common electrode 40.

The electro-optical device 1 may be configured such that a circuit other than the data line driving circuit 12 is provided to generate signals to be supplied to the data lines X in a vertical retrace period so that the pixel electrode 21 and the pixel electrode 31 have potentials the same as that of the common electrode 40. In this case, the circuit is arranged opposite the data line driving circuit 12 through the pixel unit A. Furthermore, a switch unit is interposed between the circuit and the data line driving circuit 12. The switch unit is turned on in accordance with control of the control circuit 14, and predetermined voltages are supplied from the switch unit through the data lines X. For each of the pixels, predetermined voltages are supplied to the pixel electrode 21 and the pixel electrode 31 through the corresponding one of the data lines X.

The gray-scale-level detection unit 15 detects gray-scale levels of input image signals and supplies results of the detection to the determination unit 16. Note that in this embodiment, although the gray-scale-level detection unit 15 detects gray-scale levels of the image signals in 256 gray-scale levels, the present invention is not limited to this.

The determination unit 16 determines, for each of the gray-scale levels of the image signals supplied from the gray-scale-level detection unit 15, whether the gray-scale level is within a predetermined range (for example, a range from 64 to 128) considered to be a halftone. In a case where the determination is affirmative, the control circuit 14 controls the signal supplying unit 13 so that display using pulse-surface-area modulation is performed.

Specifically, when the first switching device 24 is turned on, the signal supplying unit 13 supplies certain signals to the control lines W, and for each of the pixels, turns off the second switching device 34 in accordance with control of the control circuit 14.

Accordingly, since the first switching device 24 is in an on-state, the first subpixel 20 performs display in accordance with a corresponding one of the certain voltages supplied to the data lines X. Furthermore, since the second switching device 34 is in an off-state, the second subpixel 30 retains a certain gray-scale level representing black which has been written in the vertical retrace period resulting in black display. By this, the first subpixel 20 performs high-gray-scale-level display and the second subpixel 30 performs low-gray-scale-level display whereby pulse-surface-area modulation is performed. Accordingly, halftone display is entirely achieved in each of the pixels.

For example, if a gray-scale level detected using the gray-scale-level detection unit 15 is "64", an image signal is modulated so that the first subpixel 20 performs display with a gray-scale level of "192" and the second subpixel 30 performs display with a gray-scale level of "0" whereby pulse-surface-area modulation is performed. As described above, since the pulse-surface-area modulation is performed, response speed is improved while the entire pixel performs display with a gray-scale level of "64". In this example, the response speed is 44 msec which realizes faster halftone display by 37 msec than the normal response speed (81 msec). According to the embodiment of the invention, halftone display is performed using pulse-surface-area modulation, and therefore response speed is improved.

In a case where the determination unit 16 determines that a gray-scale level is out of the range considered to be a halftone (for example, 0 to 63 and 129 to 255), the control circuit 14 does not perform pulse-surface-area modulation but controls the data line driving circuit 12. Specifically, the control circuit 14 controls the data line driving circuit 12 to turn on the first switching device 24 and the second switching device 34 or to turn off the first switching device 24 and the second switching device 34 so that the first subpixel 20 and the second subpixel 30 perform the same gray-scale-level display.

Accordingly, the electro-optical device 1 of this embodiment performs black data insertion processing for all the pixels in a vertical retrace period and entirely performs gray-scale display in each of the pixels utilizing the first subpixel 20 and the second subpixel 30. Accordingly, blur of a motion picture is suppressed (a motion picture is improved in visual quality) by the black data insertion processing while using the minimum number of switching devices in the pixel unit A. Consequently, halftone display can be performed without performing overdrive processing.

According to the embodiment of the invention, since a memory necessary for the overdrive processing can be eliminated, a size of the entire device and production cost thereof can be reduced, and a response speed of the liquid crystal can be improved. Furthermore, the amount of electric power required for the overdrive processing can be reduced.

Note that the first subpixel 20 and the second subpixel 30 may be configured in a different area ratio.

In the above-described first and second embodiments, although each of the pixels is constituted by two subpixels, the present invention is not limited to this. Alternatively, each of the pixels may be constituted by three or more subpixels. Furthermore, image signals may be supplied to subpixels at the same time or at different times. Moreover, in the above-described first and second embodiments, although an MVA method is employed as an example of a method for driving the liquid crystal, an ECB (electrically controlled birefringence) method may be employed.

Application

Figure 6:
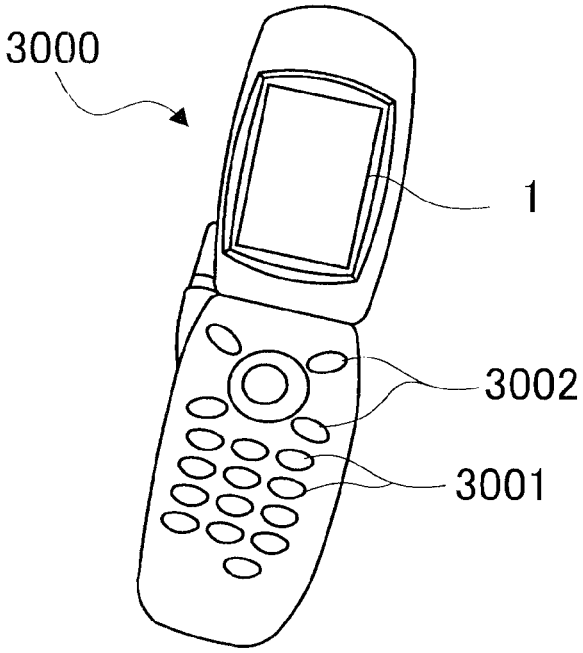
FIG. 6 shows a perspective view illustrating a configuration of a cellular phone to which the electro-optical device is applied.
Figures 7A, 7B, 7C:
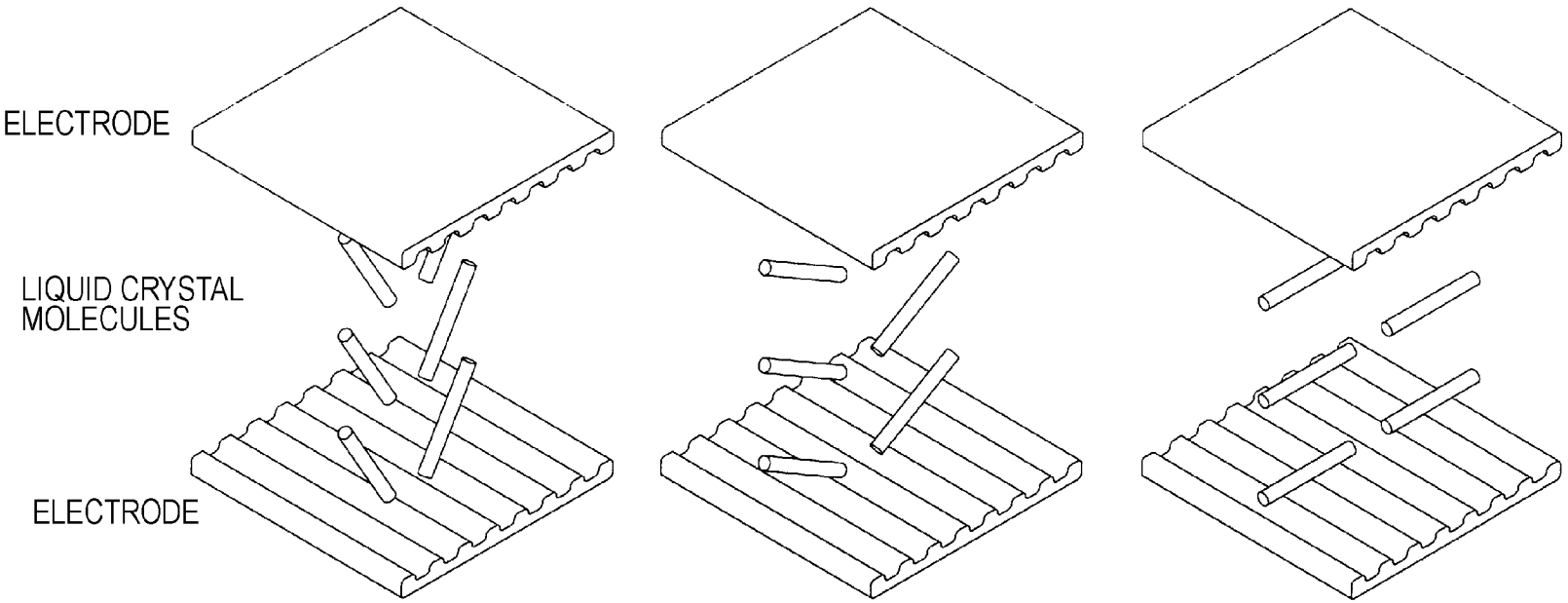
FIGS. 7A to 7C show schematic views illustrating alignment of liquid crystal molecules in a VA method.

An electronic apparatus to which the electro-optical device 1 according to the above-described embodiments is applied will be described. FIG. 6 shows a perspective view illustrating a configuration of a cellular phone to which the electro-optical device 1 is applied. A cellular phone 3000 includes a plurality of operation buttons 3001, a scroll button 3002, and the electro-optical device 1. A screen displayed on the electro-optical device 1 is scrolled by operating the scroll button 3002.

Examples of such an electronic apparatus to which the electro-optical device 1 is applicable include, in addition to the apparatus shown in FIG. 6, a personal computer, a hand-held terminal, a digital still camera, a liquid crystal display television set, a video-tape recorder having a viewfinder or a monitor directly viewed by a user, a car navigation apparatus, a pager, an electronic notebook, a calculator, a word processor, a workstation, a video telephone, a POS (point of sales) terminal, and an apparatus having a touch panel. The electro-optical device described above is applicable as a display unit to these electronic apparatuses.

The entire disclosure of Japanese Patent Application No. 2006-258774, filed Sep. 25, 2006 is expressly incorporated by reference herein.

What is claimed is:

1. An electro-optical device comprising:

a plurality of scanning lines and a plurality of data lines;

a plurality of pixels arranged so as to correspond to intersections of the plurality of scanning lines and the plurality of data lines;

a scanning line driving circuit that generates selection signals used to select the plurality of scanning lines in a predetermined order, and supplies the selection signals to the plurality of scanning lines;

a data line driving circuit that generates certain signals from input image data and supplies the certain signals to the plurality of data lines, each of the pixels being constituted by a first subpixel and at least one second subpixel, the first subpixel including a first pixel electrode, a common electrode which faces the first pixel electrode, and a first switching device which is turned on when a corresponding one of the selection signals is supplied through a corresponding one of the scanning lines and which electrically connects a corresponding one of the data lines to the first pixel electrode, the second subpixel including a second pixel electrode, a common electrode which faces the second pixel electrode, and a second switching device which electrically connects the corresponding one of the data lines to the second pixel electrode through the first switching device; and a signal supplying unit that supplies signals to control lines so that, for each of the pixels, the second switching device which is connected to a corresponding one of the control lines is turned on or off based on a grey-scale level of the input image data, wherein in a vertical retrace period, the scanning line driving circuit supplies the selection signals to the scanning lines, the signal supplying unit supplies signals to the control lines so that, for each of the pixels, the second switching device is turned on, and the data line driving circuit supplies signals to the data lines so that, for each of the pixels, potentials of the first pixel electrode and the second pixel electrode represent a maximum gray-scale level or a minimum gray-scale level such that a black data insertion processing is performed for all the pixels during the vertical retrace period, wherein when the gray-scale level of the image data for a pixel is within a halftone range, pulse-surface-area modulation is performed by controlling the first subpixel to display a first gray-scale level, and controlling the second subpixel to retain a gray-scale level written during the black data insertion processing of the vertical retrace period;

a gray-scale-level detection unit that detects the gray-scale level of the image data; and determination unit that determines whether the gray-scale level detected using the grayscale-level detection unit is within the halftone range, and wherein, in a case where the determination unit determines that the gray-scale level detected using the gray-scale-level detection unit is within a range considered to be a halftone range, for each of the pixels, when the first switching device is turned on, the signal supplying unit supplies one of the certain signals to a corresponding one of the control lines and turns off the second switching device.

2. The electro-optical device according to claim 1, wherein in each of the pixels, the first subpixel and the second subpixel are arranged so as to be adjacent to each other in a direction in which the scanning lines extend, and the pixels are arranged such that, for two vertically adjacent pixels, a first subpixel and a second subpixel which are included in different pixels and therefore which are separated by a boundary between the different pixels are arranged so as to be adjacent to each other.

3. The electro-optical device according to claim 1, wherein in each of the pixels, the first subpixel and the second subpixel are arranged so as to be adjacent to each other in a direction in which the data lines extend, and the pixels are arranged such that, for two horizontally adjacent pixels, a first subpixel and a second subpixel which are included in different pixels and therefore which are separated by a boundary between the different pixels are arranged so as to be adjacent to each other.

4. The electro-optical device according to claim 1, wherein liquid crystal having negative anisotropy of dielectric constant is arranged between the first pixel electrode and the second pixel electrode on one hand and the common electrode on the other.

5. An electronic apparatus including the electro-optical device set forth in claim 1.

6. The electro-optical device according to claim 1, wherein the signal supplying unit supplies a signal at a first level to the control lines during the black data insertion processing, and supplies a signal at a second level to the control lines during the pulse-surface-area modulation.

7. The electro-optical device according to claim 1, wherein the pulse-surface-area modulation is not performed when the gray-scale level of the image data for the pixel is out of a halftone range, and the first subpixel and the second subpixel display a same gray-scale level.

* * * * *